United States Patent [19]

Berberich

[11] Patent Number: 4,491,072

[45] Date of Patent: Jan. 1, 1985

[54] PLATE HOLDER FOR PAD PRINTING MACHINES

[76] Inventor: Bernd Berberich, Paradiesweg 24, D-7141 Schwieberdingen, Fed. Rep. of Germany

[21] Appl. No.: 518,019

[22] Filed: Jul. 28, 1983

[30] Foreign Application Priority Data

Jul. 28, 1982 [DE] Fed. Rep. of Germany ..... 3228152

[51] Int. Cl.[3] ..... B41F 31/00

[52] U.S. Cl. ..... 101/327; 101/383

[58] Field of Search ..... 101/407 BP, 333, 327, 101/382 R, 383–387

[56] References Cited

U.S. PATENT DOCUMENTS

| | | | |
|---|---|---|---|
| 764,517 | 7/1904 | Berry | 101/383 |
| 1,721,458 | 7/1929 | MacDonald | 101/327 |
| 2,373,491 | 4/1945 | Murray | 101/383 |

*Primary Examiner*—E. H. Eickholt
*Attorney, Agent, or Firm*—Thomas W. Speckman

[57] ABSTRACT

A printing plate holder for pad printing machines is comprised of a plate-shaped base body that has a recessed ink reservoir on its upper surface extending parallel to the back. Located in the area of the plate holder in front of the ink reservoir is a receptacle which is dimensioned to accommodate the measurements of the desired size printing plate which is held by clamping means. For the plate holder to accept plates of various sizes, the ink reservoir and the plate receptacle extend over the entire width of the base body with the same cross section. Two clamping bars function to adjust the width of the ink reservoir and of the plate receptacle to the width of the printing plate used. The undersides of the clamping bars are constructed to conform to the contours of the top surface of the base body and are provided with a flexible, solvent resistant sealant coating.

17 Claims, 6 Drawing Figures

PLATE HOLDER FOR PAD PRINTING MACHINES

BACKGROUND OF THE INVENTION

1. Field of the Invention

This invention relates to a printing plate holder for pad printing machines, comprising a plate-shaped base body with a recessed ink reservoir on its upper side extending parallel to the back. In the area in front of the ink reservoir, the base body is provided with a receptacle dimensioned to accommodate the measurements of the printing plate and a clamping means is provided for holding the plate.

2. Description of the Prior Art

A pad printing machine using such plate holders is disclosed in German patent publication No. DE-AS 19 39 437. In this prior plate holder, the ink reservoir and the plate receptacle are simply in the form of depressions in the top surface of the base body in an appropriately aligned relationship to each other. The dimensions of the plate receptacle exactly matches the dimensions of the plate. This particular construction consequently requires a different plate holder for each differently sized plate. In view of the multiplicity of different sizes of plates this means that as many plate holders as different sizes of plates must be kept in stock. Furthermore, changing a plate also necessitates changing the plate holder so that the setup times are unduly increased.

SUMMARY OF THE INVENTION

It is the object of the present invention to provide a printing plate holder of the foregoing type which is a permanent component part of a pad printing machine and is capable of holding plates of various sizes permitting quick and easy exchange of the plates.

This is accomplished according to the invention in that the ink reservoir and the plate receptacle extend with the same cross section over the entire width of the base body, and that the width of the ink reservoir and the plate receptacle is adjustable by means of two clamping bars to the width of the printing plate used. The underside of the clamping bars are constructed to conform to the contours of the top surfaie of the base body and are provided with a flexible, solvent resistant sealant coating.

The base body is so constructed that it can be adjusted to any desired width by means of the two adjustable clampimg bars. Simultaneously, the clamping bars function to seal off the variable ink reservoir, thereby automatically adjusting it to the size of the inserted plate.

A definitive sealing off and adjustment of the plate in the area of the upper side of the base body is achieved according to one embodiment of the invention in that the plate receptacle takes the form of a depression the depth of which is greater than the thickness of the plate used, that the bottom of the plate receptacle is provided with thrust bolts which are adjustable with respect to the plate by means of set screws, that the upper side of the plate is adjustable so as to be flush with the upper edges of the adjoining grooved walls of the plate receptacle, and that clamping bars extend over and thus seal off the marginal portions of the plate.

A continuous height adjustment of the thurst bolts, with the plate holder being in place in the pad printing machine, is achieved according to one embodiment, in that the thrust bolts are provided with a transversely directed wedge-shaped receptacle into which a wedge-shaped tip of a set screw is insertable, and that the set screws are screwed into threaded holes in the base body which extend horizontally in the front section of the base body.

The plate receptacle can readily be adjusted to various dimensions in the depth of the base body according to another embodiment in that the ink reservoir is trapezoidal in cross section and that the wall of the ink reservoir facing the plate receptacle is in the form of a bar which is adjustable in the depth of the base body and, in combination with the wall facing away from the ink reservoir, constitutes the walls of the channel-shaped plate receptacle.

A sufficient stepwise adjustment can be achieved in that the bar is provided at its underside with projections to engage recesses in the base body, and that the recesses are disposed at different distances from the front of the base body.

The printing plate inserted in the plate receptacle is secured according to another embodiment, in that the channel wall of the plate receptacle facing away from the ink reservoir is constituted by a molding section attached to the front side. The molding section and the channel bottom together form a receptacle whereby the molding section covers part of the opposite edge of the inserted plate. The molding section as a part of the thus constructed receptacle accommodates a thrust bar which is secured against the inserted plate by means of pressure screws adjustable within the molding section.

For a fixed immovable mounting of the clamping bars on the base body of the plate holder, one embodiment provides that the clamping bars are provided at their ends with means to receive fastening screws, that the clamping bars embrace the front and back side of the base body by means of flanges, and that the fastening screws are adapted to be screwed into threaded holes provided in clamping blocks which extend in the rear of the underside of the base body.

To achieve a positive support of the clamping block on the underside of the base body, according to another embodiment, the underside of the base body in the front and back regions is provided with a continuous receiving groove into which projections engage upwardly from the clamping blocks. The receiving groove of the base body and the guide projections of the clamping blocks form the composite parts of a dovetail joint.

BRIEF DESCRIPTION OF THE DRAWING

The invention will be described in further detail with reference to several embodiments illustrated in the drawings, in which.

DESCRIPTION OF PREFERRED EMBODIMENTS

Figure 1:
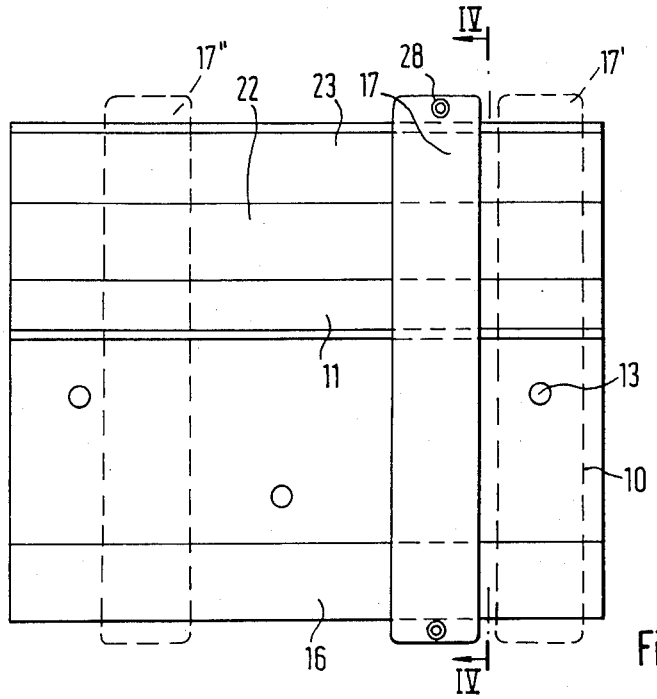
FIG. 1 is a top plan view of a printing plate holder according to the invention.
Figure 2:
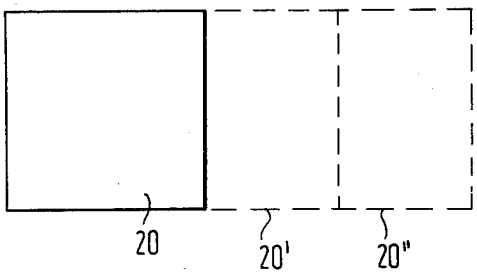
FIG. 2 is a diagrammatic view of several plates of different size.
Figure 4:
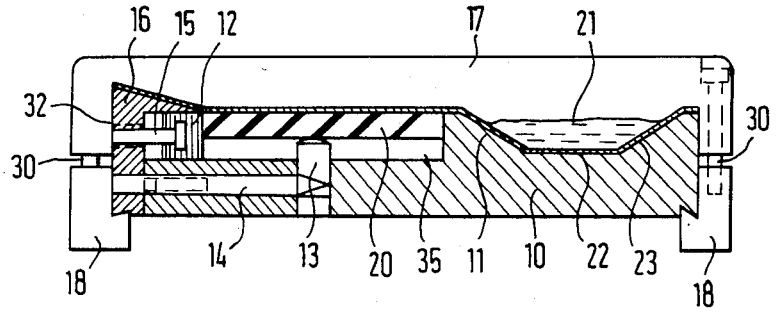
FIG. 4 is a sectional view of the plate holder of FIG. 1, taken along the line IV—IV.

Referring to FIGS. 1 and 4, the plate holder according to the invention is comprised of a plate-shaped base body 10. Disposed in the back area of base body 10 is a continuous ink reservoir 21 which is trapezoid in cross section, as is shown by side walls 11 and 23 and bottom 22. Disposed in front of ink reservoir 21 is a similarly continuous plate receptacle 35. The section of base body 10 which forms wall 11 for the ink reservoir 21 also forms a wall of the groove-shaped plate receptacle 35. The depth of plate receptacle 35 is greater than the thickness of the plate. As shown in FIG. 2, the inserted plate 20 may be of different widths as is indicated by the broken lines 20' and 20'', while the depth of the base body 10 remains the same.

The front or forward wall of groove-shaped receptacle 35 is not formed by a part of base body 10. Secured to the front face of base body 10 is a molding section 16 which covers part of plate receptacle 35 and itself forms a receptacle for thrust bars 12. Thrust bars 12 constitute the forward wall of groove-shaped plate receptacle 35 and are adjustable by threaded bolts 15 which themselves are adjustable within molding section 16. The inserted plate can thus be forced against the stationary rear wall of groove-shaped plate receptacle 35. Prior thereto, however, plate 20 is adjusted as to height by means of thrust or pressure bolts 13 disposed in the bottom of plate receptacle 35 so that the top surface of plate 20 is flush with the top surface of wall 11 and the upward sloping surface of molding section 16.

Thrust bolts 13 are provided with a transversely directed wedge-shaped receptacle 26 into which the wedge-shaped tip of screw 14 is inserted. Set screws 14 are screwed into threaded holes 27 horizontally extending into base body 10 on its front side. Molding section 16 has bores 31 permitting accessibility to threaded holes 27. In this manner, thrust bolts 13 can be adjusted as to height from the front of a plate holder mounted in the pad printing machine. It is merely necessary to screw set screws 14 to a greater or lesser extent into threaded holes 27. The wedge-shaped tips of the screws 14 extending into the wedge-shaped receptacles 26 in thrust bolts 13 correspondingly raise thrust bolts 13 to a greater or lesser extent, and plate 20 position on the thrust bolts 13 is accordingly adjusted as to height along with the bolts 13.

Figure 5:
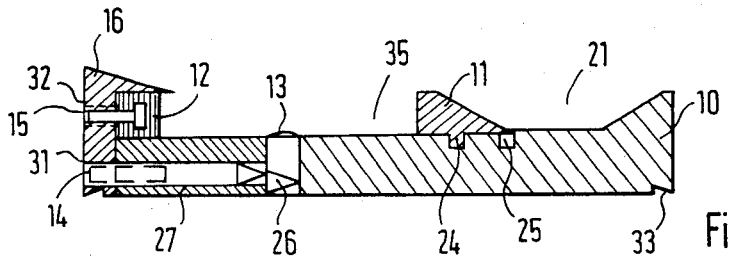
FIG. 5 is a sectional view of a plate holder having a different configuration and being removed from the clamping bars.

As is shown in the sectional view of FIG. 5, wall 11 of ink reservoir 21 is constituted by a part of a bar which may be mounted at different spacings from the front face of base body 10. Thus, plate receptacle 35 can be adjusted to different measurements of the plates 20' and 20'' also by this adjustment on base body 10. In many instances it has proven sufficient for the bar to be stepwise adjustable. To this end, it is merely necessary to provide the underside of the bar with projections 24. Recesses 25 are arranged in the top surface of the base body 10 at different distances from the front. Otherwise, the construction of the plate holder of FIG. 5 is the same as the construction of the plate holder of FIGS. 1 and 3.

Figure 3:
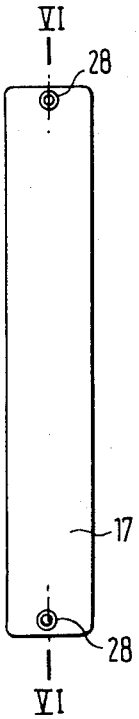
FIG. 3 is a view of a clamping bar removed from the base body.
Figure 6:
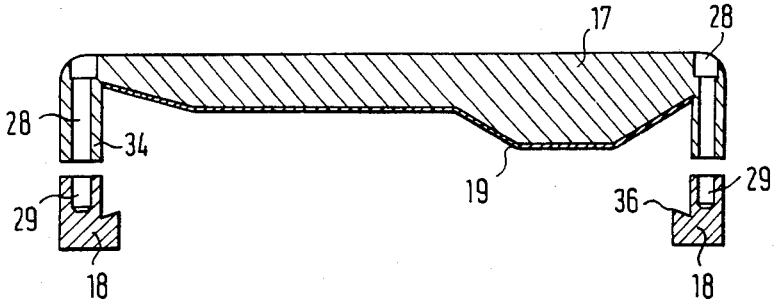
FIG. 6 is a sectional view of the clamping bar of FIG. 3 taken along the line VI—VI.

As shown in FIG. 1, the width of ink reservoir 21 is automatically adjusted to the width of inserted plate 20 by the action of two clamping bars 17 shown in FIGS. 3 and 6. The undersides of clamping bars 17 conform to the contour of the top surface of the base body 10 and are provided with a flexible solvent resistant coating of sealant 19. Thus, continuous ink reservoir 21 is closed at both sides by clamping bars 17. In the region of inserted plate 20, the clamping bars cover the marginal portions of plate 20 and thus perform a sealing function with respect to the upper side of plate 20, as will be seen from the sectional view of FIG. 4. The smooth, flush transition from plate 20 to the wall and the upward sloping portion of the molding section 16 is thereby ensured and a definitive sealing is obtained.

Base body 10 is embraced by flanges 34 of clamping bars 17. Disposed in flanges 34 are stepped receptacles 28 for fastening screws 30 to be screwed into threaded bores 29 provided in clamping blocks 18. Projecting from clamping blocks 18 are mating extensions 36 for engagement with receiving grooves 33 on the underside of base body 10. These receiving grooves 33 are continuous on the front and the back side so that clamping bars 17, upon loosening fastening screws 30, can easily be slidably moved to any desired location on base body 10. Grooves or mortises 33 in base body 10 and projections or tenons 36 of clamping blocks 18 form the constituent parts of dovetail type joints in this embodiment.

I claim:

1. Printing plate holder for pad printing machines, comprising a plate-shaped base body with an ink reservoir recessed in the upper side of the base body and extending parallel to the back, the area of the base body in front of the ink reservoir being provided with a plate receptacle which is dimensioned to accommodate the measurements of a printing plate and clamping means, characterized in that said ink reservoir (21) and said plate receptacle (35) each have the same cross section for and extend for the entire width of said base body (10), and that the width of said ink reservoir (21) and said plate receptacle (35) is adjustable to the width of any desired plate (20, 20', 20'') used by means of two clamping bars (17), the undersides of said clamping bars (17) being constructed to conform to the contours of the upper side of said base body (10) and being provided with a flexible solvent resistant sealant coating (19).

2. Printing plate holder according to claim 1, characterized in that said plate receptacle (35) is in the form of a channel the depth of which is greater than the thickness of the plate (20, 20', 20'') used, that the bottom of said plate receptacle (35) is provided with multiple upwardly extending thrust bolts (13) which are vertically adjustable with respect to said plate (20, 20', 20'') by means of set screws (14) so that the upper side of said plate (20, 20', 20'') may be adjusted to be flush with the upper edges of the adjoining channel walls of said plate receptacle (35), and that said clamping bars (17) extend over and seal off the marginal portions of said plate (20, 20', 20'').

3. Printing plate holder according to claim 2, characterized in that said thrust bolts (13) are provided with a transversely directed wedge-shaped receptacle (26) into which a wedge-shaped tip of said set screw (14) is insertable, and that said set screws (14) are screwably engaged in threaded holes (27) in said base body (10) extending horizontally into the front section of said base body (10).

4. Printing plate holder according to claim 3, characterized in that said ink reservoir (21) is trapezoidal in cross section, and that one wall (11) of said ink reservoir (21) facing said plate receptacle (35) is in the form of a bar which is adjustable in the depth of said base body (10) and, in combination with a facing wall away from said ink reservoir (21) constitutes walls of said channel-shaped plate receptacle (35).

5. Printing plate holder according to claim 4, characterized in that said bar is provided at its underside with projections (24) to engage recesses (25) provided in said base body (10), and that said recesses (25) are disposed at different distances from the front of said base body (10).

6. Printing plate holder according to claim 1, characterized in that said ink reservoir (21) is trapezoidal in cross section, and that one wall (11) of said ink reservoir (21) facing said plate receptacle (35) is in the form of a bar which is adjustable in the depth of said base body (10) and, in combination with a facing wall away from said ink reservoir (21) constitutes walls of said channel-shaped plate receptacle (35).

7. Printing plate holder according to claim 6, characterized in that said bar is provided at its underside with projections (24) to engage recesses (25) provided in said base body (10), and that said recesses (25) are disposed at different distances from the front of said base body (10).

8. Printing plate holder according to claim 1, characterized in that the channel wall of said plate receptacle (35) facing away from said ink reservoir (21) is constituted by a molding section (16) attached to the front section of said base body (10), said molding section and the channel bottom together forming a receptacle, said clamping bars (17) covering part of the opposite edges of said inserted plate (20, 20', 20'') and said molding section (16) comprising a thrust bar (12) which is forced against said inserted plate (20, 20', 20'') by means of pressure screws (15) adjustable within said molding section (16) holding said plate in said receptacle.

9. Printing plate holder according to claim 5, characterized in that the channel wall of said plate receptacle (35) facing away from said ink reservoir (21) is constituted by a molding section (16) attached to the front section of said base body (10), said molding section and the channel bottom together forming a receptacle, said clamping bars (17) covering part of the opposite edges of said inserted plate (20, 20', 20'') and said molding section (16) comprising a thrust bar (12) which is forced against said inserted plate (20, 20', 20'') by means of pressure screws (15) adjustable within said molding section (16) holding said plate in said receptacle.

10. Printing plate holder according to claim 7, characterized in that the channel wall of said plate receptacle (35) facing away from said ink reservoir (21) is constituted by a molding section (16) attached to the front section of said base body (10), said molding section and the channel bottom together forming a receptacle, said clamping bars (17) covering part of the opposite edges of said inserted plate (20, 20', 20'') and said molding section (16) comprising a thrust bar (12) which is forced against said inserted plate (20, 20', 20'') by means of pressure screws (15) adjustable within said molding section (16) holding said plate in said receptacle.

11. Printing plate holder according to claim 1, characterized in that said clamping bars (17) are provided at their ends with through bores (28) to receive fastening screws (30), that said clamping bars (17) embrace the front and back of said base body (10) by means of flanges (34), and that said fastening screws (30) are adapted to be engaged in threaded holes (29) provided in clamping blocks (18) which extend beneath the underside of said base body (10).

12. Printing plate holder according to claim 11, characterized in that the underside of said base body (10) in the front and back regions is provided with a continuous receiving groove (33) to be engaged by guide projections (36) projecting from said clamping blocks (18).

13. Printing plate holder according to claim 12, characterized in that said receiving grooves (33) of said base body (10) and said guide projections (36) of said clamping blocks (18) form the constituent parts of a dovetail like joint.

14. Printing plate holder according to claim 3, characterized in that said clamping bars (17) are provided at their ends with through bores (28) to receive fastening screws (30), that said clamping bars (17) embrace the front and back of said base body (10) by means of flanges (34), and that said fastening screws (30) are adapted to be engaged in threaded holes (29) provided in clamping blocks (18) which extend beneath the underside of said base body (10).

15. Printing plate holder according to claim 5, characterized in that said clamping bars (17) are provided at their ends with through bores (28) to receive fastening screws (30), that said clamping bars (17) embrace the front and back of said base body (10) by means of flanges (34), and that said fastening screws (30) are adapted to be engaged in threaded holes (29) provided in clamping blocks (18) which extend beneath the underside of said base body (10).

16. Printing plate holder according to claim 7, characterized in that said clamping bars (17) are provided at their ends with through bores (28) to receive fastening screws (30), that said clamping bars (17) embrace the front and back of said base body (10) by means of flanges (34), and that said fastening screws (30) are adapted to be engaged in threaded holes (29) provided in clamping blocks (18) which extend beneath the underside of said base body (10).

17. Printing plate holder according to claim 8, characterized in that said clamping bars (17) are provided at their ends with through bores (28) to receive fastening screws (30), that said clamping bars (17) embrace the front and back of said base body (10) by means of flanges (34), and that said fastening screws (30) are adapted to be engaged in threaded holes (29) provided in clamping blocks (18) which extend beneath the underside of said base body (10).

* * * * *